US009132950B1

(12) United States Patent
Anderson et al.

(10) Patent No.: US 9,132,950 B1
(45) Date of Patent: Sep. 15, 2015

(54) EXTENDED TWIST BLAST

(76) Inventors: Michael R. Anderson, Deerfield Beach, FL (US); Lillemor I. Anderson, Arroyo Grande, CA (US)

( * ) Notice: Subject to any disclaimer, the term of this patent is extended or adjusted under 35 U.S.C. 154(b) by 135 days.

(21) Appl. No.: 13/478,419

(22) Filed: May 23, 2012

Related U.S. Application Data

(60) Provisional application No. 61/490,971, filed on May 27, 2011.

(51) Int. Cl.
*B65D 81/32* (2006.01)

(52) U.S. Cl.
CPC ..... *B65D 81/32* (2013.01)

(58) Field of Classification Search
CPC ..... B65D 81/32; B65D 81/3205; B65D 51/2821; B65D 81/3211; B65D 81/3255; B65D 51/28; B65D 81/3266; B01F 13/005
USPC ..... 206/222, 219, 220, 568; 215/DIG. 8; 220/521
See application file for complete search history.

(56) References Cited

U.S. PATENT DOCUMENTS 3,347,410 A * 10/1967 Schwartzman ..... 222/80
4,773,529 A * 9/1988 Finke et al. ..... 206/222
5,839,573 A * 11/1998 Morini ..... 206/221
5,927,549 A * 7/1999 Wood ..... 222/83
6,003,728 A * 12/1999 Elliott ..... 222/81
6,305,576 B1 * 10/2001 Leoncavallo ..... 222/83.5
6,609,634 B2 * 8/2003 De Laforcade et al. ..... 222/1
7,178,683 B2 2/2007 Birkmayer et al.
7,347,322 B2 * 3/2008 Cho ..... 206/222
7,748,550 B2 * 7/2010 Cho ..... 215/228
7,870,952 B2 * 1/2011 Fontana ..... 206/222
8,297,456 B1 * 10/2012 Anderson ..... 215/227
2008/0142473 A1 * 6/2008 Cho ..... 215/252
2008/0223741 A1 * 9/2008 Nyambi et al. ..... 206/222
2010/0044377 A1 * 2/2010 Porter ..... 220/212
2010/0163442 A1 * 7/2010 Lee et al. ..... 206/222
2010/0282624 A1 * 11/2010 Paganuzzi ..... 206/222
2011/0266171 A1 * 11/2011 Rovelli ..... 206/222

* cited by examiner

*Primary Examiner* — Steven A. Reynolds
(74) *Attorney, Agent, or Firm* — Malin Haley DiMaggio & Bowen, P.A.

(57) ABSTRACT

A dispensing capsule has an upper cap having a concave depression and a lower cap. The lower cap defines an internal chamber adapted to contain a first ingredient and has an upper flexible seal, a lower sealing member, and a plunger disposed in the internal chamber, whereby the plunger is engaged with the upper flexible seal. The flexible seal may be a blast or flexible bellow. The upper cap is threadingly engaged with the lower cap and lower cap adapted to threadingly engage a container, such as a bottle, IV bag, or the like. Twisting the upper cap with respect to the lower cap causes the concave depression to apply downward force to the upper flexible seal, causing the plunger to displace downward and break the lower sealing member, dispensing said first ingredient from the internal chamber into the container below.

4 Claims, 10 Drawing Sheets

EXTENDED TWIST BLAST

CROSS REFERENCE TO RELATED APPLICATIONS

This application claims the benefit of U.S. Provisional Application Ser. No. 61/490,971 filed on May 27, 2011.

STATEMENT REGARDING FEDERALLY SPONSORED RESEARCH OR DEVELOPMENT

N/A

BACKGROUND OF THE INVENTION

1. Field of the Invention

The present invention generally relates to dispensing capsules and more particularly to a dispensing capsule having a sealed ingredient chamber and a plunger that is activated by a twisting motion.

2. Description of Related Art

Most all liquids, creams, gels and even certain powders and other substances are formulated and created for the longest shelf life and not necessarily for optimal performance and/or usefulness. There are many ingredients and/or combinations of ingredients that have reduced shelf life due to requiring combinations of liquid substances. In most all cases when any ingredients are exposed to one another, including air, deterioration begins and the clock on the limited shelf life starts. Also in most products in any category, "Shelf Life" is the key factor with respect expiration dates based on the product and category.

Several attempts have been made to design capsules and containers to improve the shelf life of compositions such as gels, liquids, powders and the like however the majority of the available device rely on a plurality of interconnected parts which are not cost effect to manufacture and assemble. The present invention is designed to be inexpensive to mass produce, fill and seal to be able to deliver an affordable dispensing capsule in virtually any application and category. This invention can be made from a one piece mold or more pieces depending on the desired application with features and benefits for keeping ingredients separate and fresh until time of use. This invention allows formulas and new products in any categories to be invented and made for desired end effects and not for what has to be done do to normal packaging and manufacturing and eliminating many unhealthy ingredients that are currently and normally used to produce most products. The present invention, therefore, is useful for packaging ingredients such as enzymes, calcium and magnesium with bio flavinoids vitamin C, probiotics creatine and many more. The present invention is not like any other chamber cap found and is much needed in the industry for solving stability and formula and ingredient problems at the same time making products healthier for a human and the environment.

It is, therefore, to the effective resolution of the aforementioned problems and shortcomings of the prior art that the present invention is directed. However, in view of the container capsules and related devices in existence at the time of the present invention, it was not obvious to those persons of ordinary skill in the pertinent art as to how the identified needs could be fulfilled in an advantageous manner.

SUMMARY OF THE INVENTION

In some embodiments, the present invention comprises a dispensing capsule having a sealed ingredient chamber and a dispensing plunger that is activated by a twisting motion.

In some embodiments, the dispensing capsule comprises an upper cap having a concave depression and a lower cap. The lower cap defines an internal chamber adapted to contain a first ingredient and has an upper flexible seal, a lower sealing member, and a plunger disposed in the internal chamber, whereby the plunger is engaged with the upper flexible seal. The flexible seal may comprise a blast or flexible bellow. The upper cap is threadingly engaged with the lower cap and lower cap adapted to threadingly engage a container, such as a bottle, IV bag, or the like. Twisting the upper cap with respect to the lower cap causes the concave depression to apply downward force to the upper flexible seal, causing the plunger to displace downward and break the lower sealing member, dispensing said first ingredient from the internal chamber.

In some embodiments, a lower portion of the upper cap includes one or more cut-outs, the cut-outs configured to lockingly engage one or more protrusions on the inside of an outer race of the lower cap after the capsule is activated. The distal end of the plunger includes a tip for breaking the lower sealing member. The internal chamber is adapted to contain a solid, a liquid, a gas, or combinations thereof and this first ingredient is adapted to mix with a second ingredient contained in the container.

The dispensing capsule may further comprise a cover covering said upper cap. The upper cap may further comprises a spout in flow communication with a plug, wherein a bottom portion of the plug is fit against a pressure seal. In this configuration, upon twisting the upper cap with respect to the lower cap, the plug displaces downward breaking the pressure seal and providing a flow pathway from said plunger through to the spout. A hinged lid may cover the spout. This configuration provides a drinking or dispensing feature which allows for the first and second ingredient mixture to travel up and out through the spout at the top of the upper cap.

The capsule can be attached or mounted to any location of a container for keeping the ingredient in the ingredient chamber fresh and hermetically sealed prior to use. The invention can be made of any shape or size or material including a variety of means of attaching to a container including threads, snap fit, adhering to and even manufactured within a container depending on the application of use.

Accordingly, it is an object of this invention to provide a dispensing capsule having a sealed ingredient chamber and a dispensing plunger that is activated by a twisting motion.

It is another object of the present invention to provide a dispensing capsule that hermetically contains a first ingredient to be dispensed and mixed with a second ingredient.

It is another object of the present invention to provide a dispensing capsule that is easy to operate, safe, hygienic, and versatile.

It is another object of the present invention to provide a dispensing capsule that can increase the shelf-life of mixtures and other compositions.

In accordance with these and other objects which will become apparent hereinafter, the instant invention will now be described with particular reference to the accompanying drawings.

DETAILED DESCRIPTION

Figure 1:
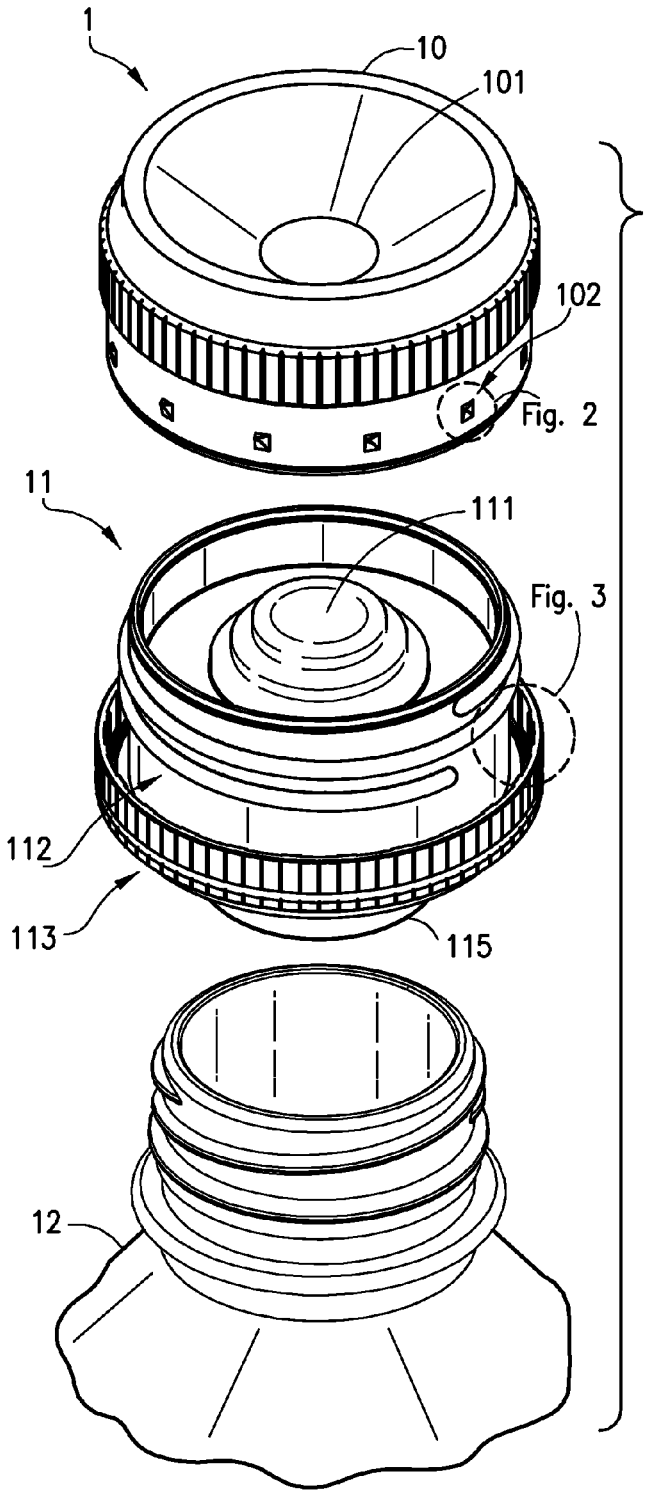
FIG. 1 is a breakaway view of one embodiment of the dispensing capsule of the present invention.
Figure 2:
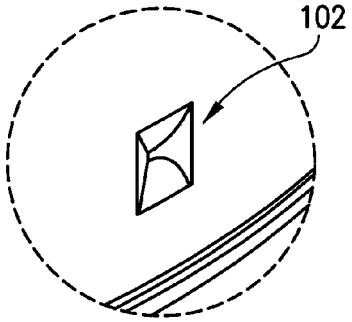
FIG. 2 is an exploded view of a locking feature of the dispensing capsule of the present invention shown in FIG. 1.
Figure 3:
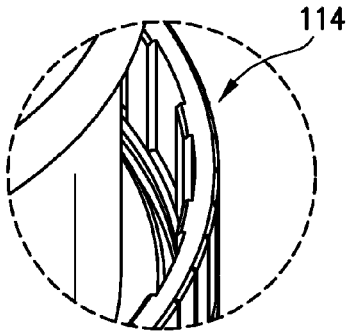
FIG. 3 is an exploded view of another locking feature of the dispensing capsule of the present invention shown in FIG. 1.
Figure 4:
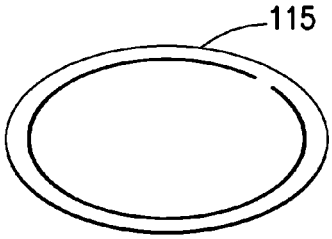
FIG. 4 is an exploded view of the sealing member of the dispensing capsule of the present invention.

With reference to FIGS. 1-4, shown is an exploded perspective view and various up-close views of one embodiment of the dispensing capsule 1 of the present invention. Dispensing capsule comprises upper cap 10 and lower cap 11 whereby the bottom of the upper cap 10 engages the lower cap 11 and the bottom of the lower cap 11 engages a container 12. The lower cap 11 is configured to contain and store a first ingredient which is desired to be mixed with a second ingredient contained in container 12.

Upper cap 10 has a concave depression 101 which is in contact with a plunger seal 111 of the lower cap 11. In some embodiments, the concave depression 101 is engaged with plunger seal 111, which plunger seal 111 is flexible. In some embodiments, the plunger seal 111 is configured as a flexible blast or bellow or stepped bellow type seal that can be displaced downward as described in detail below. The concave depression 101 provides a means to activate the dispensing, which will be described in further detail below.

In some embodiments, the upper cap 10 is configured to threadably engage the threaded section 112 of the lower cap 11. Accordingly, the inside of upper cap 10 may have corresponding threads to allow for the engagement. Further, the lower portion of upper cap 10 may have one or more cut-outs 102 around its circumference (See FIG. 2), which are configured to lockingly engage one or more protrusions 114 (FIG. 4) inside the outer race 113 of the lower cap 11. The engagement of the cut-outs 112 with the protrusions 114 prevent the upper cap 10 from being disengaged from the lower cap 11 after the dispensing 1 is activated, preventing tampering and the like. The bottom of lower cap 11 also includes a lower sealing member 115 (FIG. 4) such as a foil or plastic seal which is breakable as discussed below. Accordingly, the plunger seal 111 and the lower sealing member 115 combine to delimit an interior portion or chamber 116 of the lower cap 11 which contains a first ingredient to be mixed with a second ingredient in the container 12.

Figure 5:
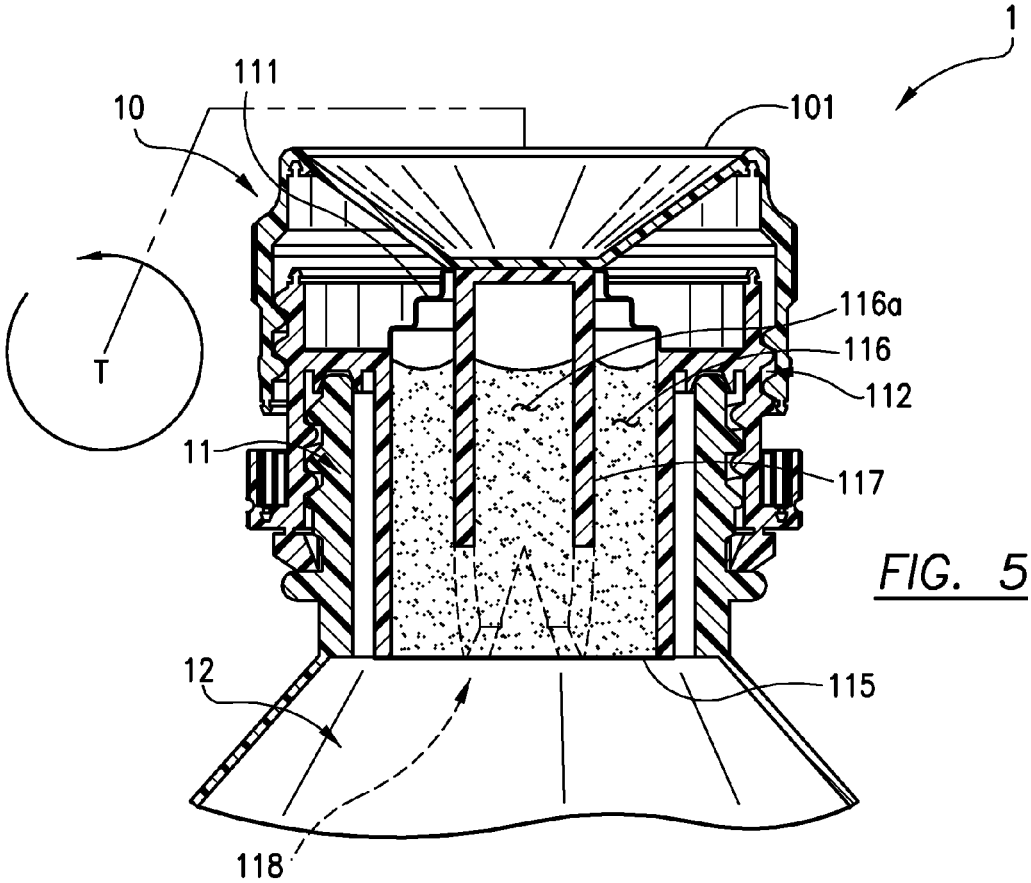
FIG. 5 is a sectional view of one embodiment the dispensing capsule of the present invention in a pre-engaged state.
Figure 6:
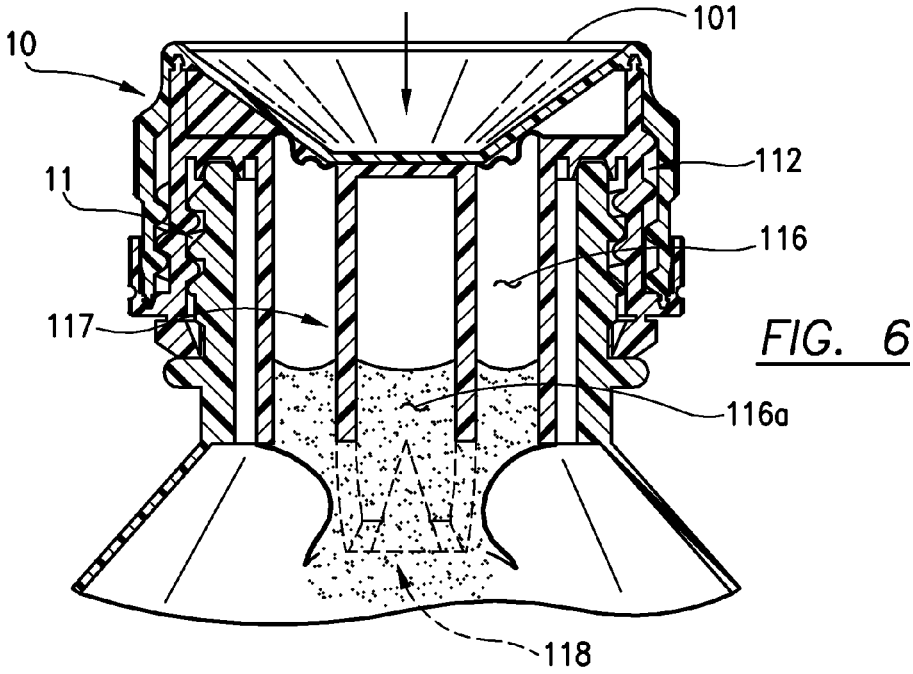
FIG. 6 is a sectional view of one embodiment of the dispensing capsule of the present invention in an engaged or deployed state.

With references to FIGS. 5-6, shown is a sectional view of one embodiment of the dispensing capsule 1 of the present invention. The lower cap 11 delimits an inner chamber 116 which contains a first ingredient **116*a*. Also disposed within the chamber 116 is a moveable plunger 117 which is engaged at the top to plunger seal 111. In some embodiments, the plunger is hollow. As noted previously, bottom of the lower cap 11 is sealed by lower sealing member 115. Accordingly, the plunger 117 is disposed between the upper plunger seal 111 and the lower sealing member 115. In FIG. 5, the upper cap 10 is shown as received onto and threaded with lower cap 11 such that upper cap 10 provides a means to activate the device by twisting (see rotational axis T) at least a portion of the upper cap 10 such that the upper cap 10 moves downward such that the concave depression 101 provides downward force to the plunger seal 111 of the lower cap 11. As the upper cap 10 and the flexible plunger seal 111 moves downward, plunger 117 also translates downward within chamber 116 until the distal end 118 of plunger 117 punctures lower sealing member 115, releasing first ingredient 116*a* downward into container 12. In the case where container 12 contains a second ingredient, the two ingredients can now mix. In some embodiments, distal end 118 comprises a forked tip as shown, but other configurations such as a single pointed tip may be equally suited provided it is capable of breaking lower sealing member 115 with sufficient pressure placed on plunger 117 by way of the twisting action of upper cap 10**.

It is appreciated that the twisting action of upper cap 10 causes upper cap 10 to rotated about and downward along its threaded engagement with threads 112 of lower cap 11. In some embodiments, upper cap 10 is at least partially engaged with the threads 112 without the plunger 117 being activated by the concave depression 101. Accordingly, the upper cap 10 may be preinstalled on the lower cap 11 without activation and then, with sufficient twisting, upper cap 10 moves downward enough such that the concave depression 101 engages the plunger seal 111 and the device activates. In some embodiments, once upper cap 10 is fully disposed downward about threads 112, the cut-outs 102 will engage the inner wall of the outer race 113 and protrusions 114 will lock the upper cap 10 in place within lower cap 11. It is appreciated that the twisting action can be carried out by manual effort by way of the user's hands.

Figure 7:
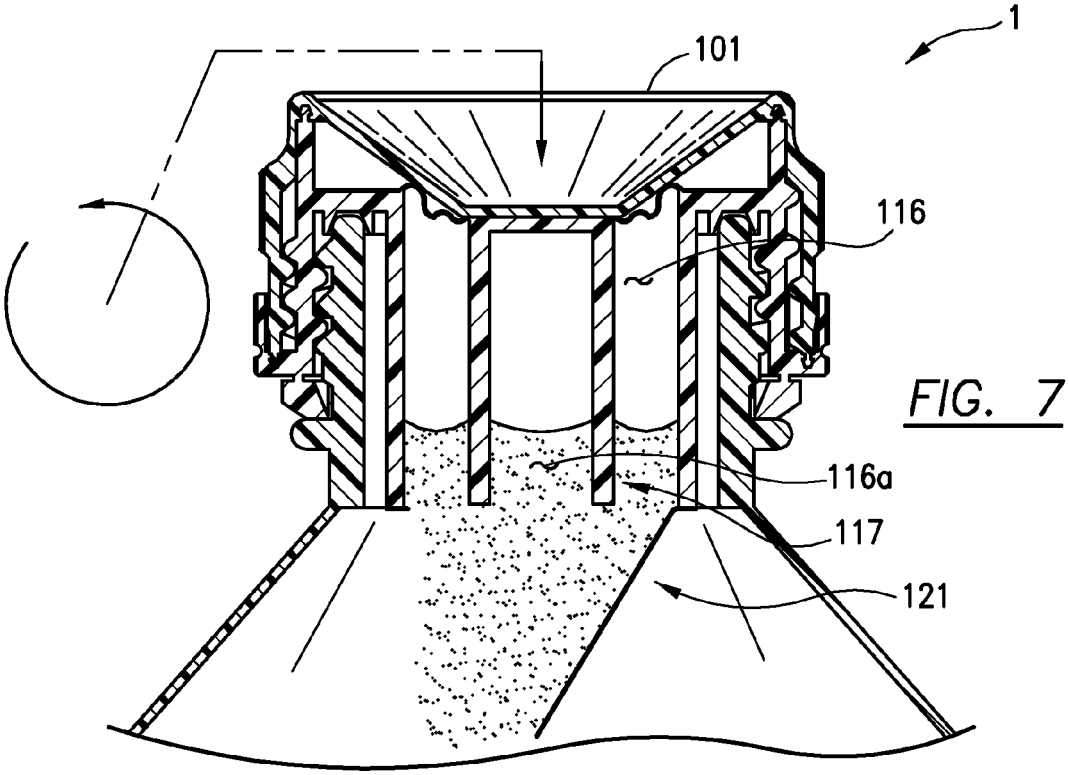
FIG. 7 is a sectional view of another embodiment of the dispensing capsule of the present invention in an engaged or deployed state.
Figure 8:
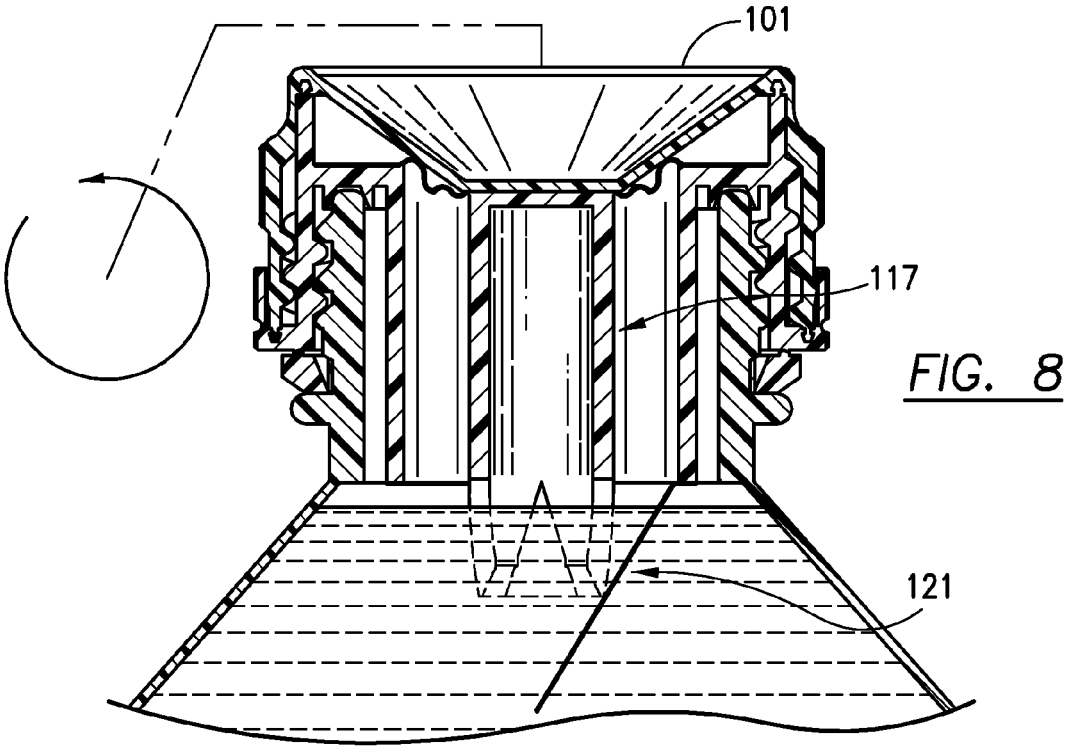
FIG. 8 is a sectional view of another embodiment of the dispensing capsule of the present invention in an engaged or deployed state.
Figure 9:
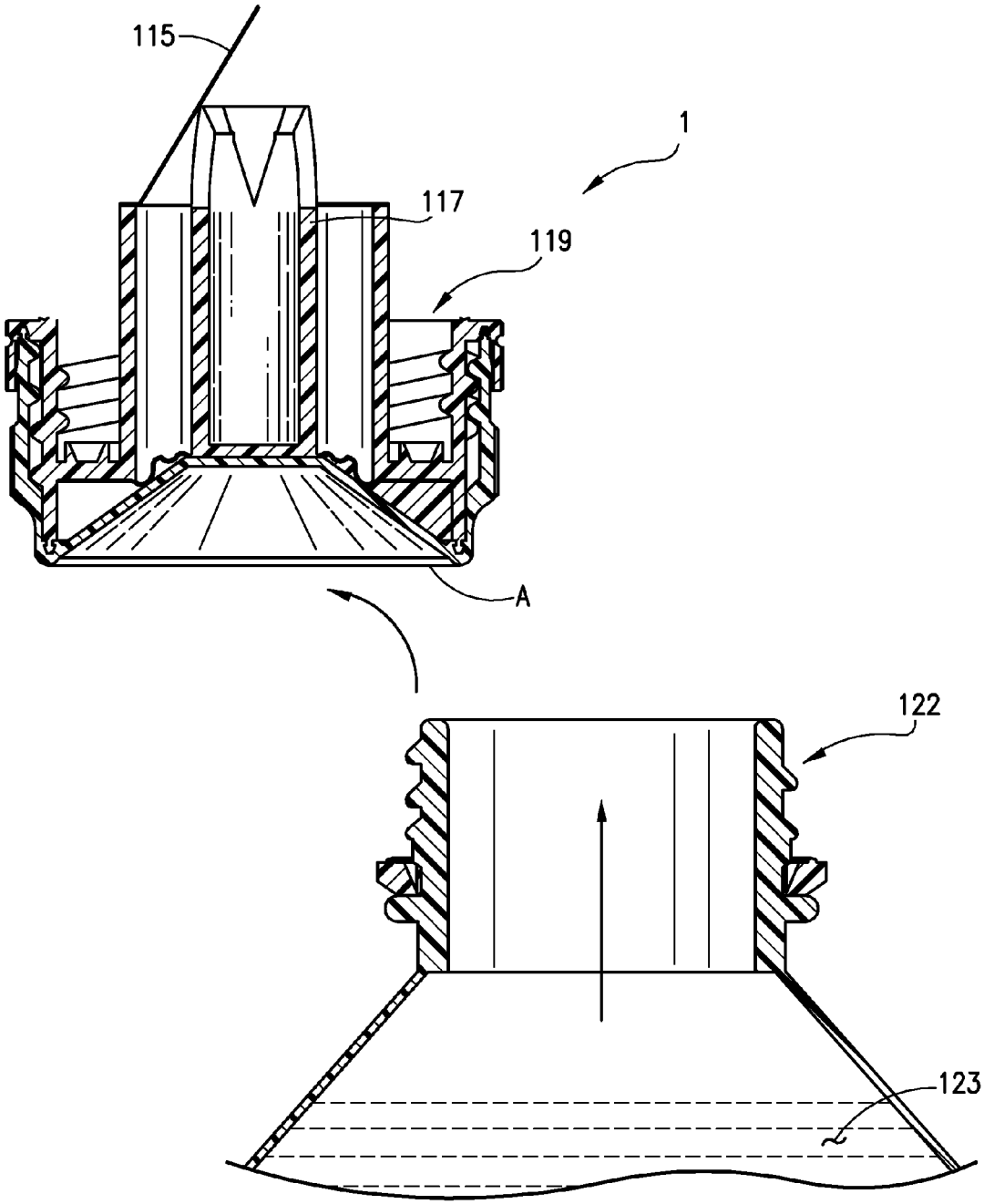
FIG. 9 is a sectional view of one embodiment of the dispensing capsule of the present invention separated from a container containing a second ingredient.
Figure 10:
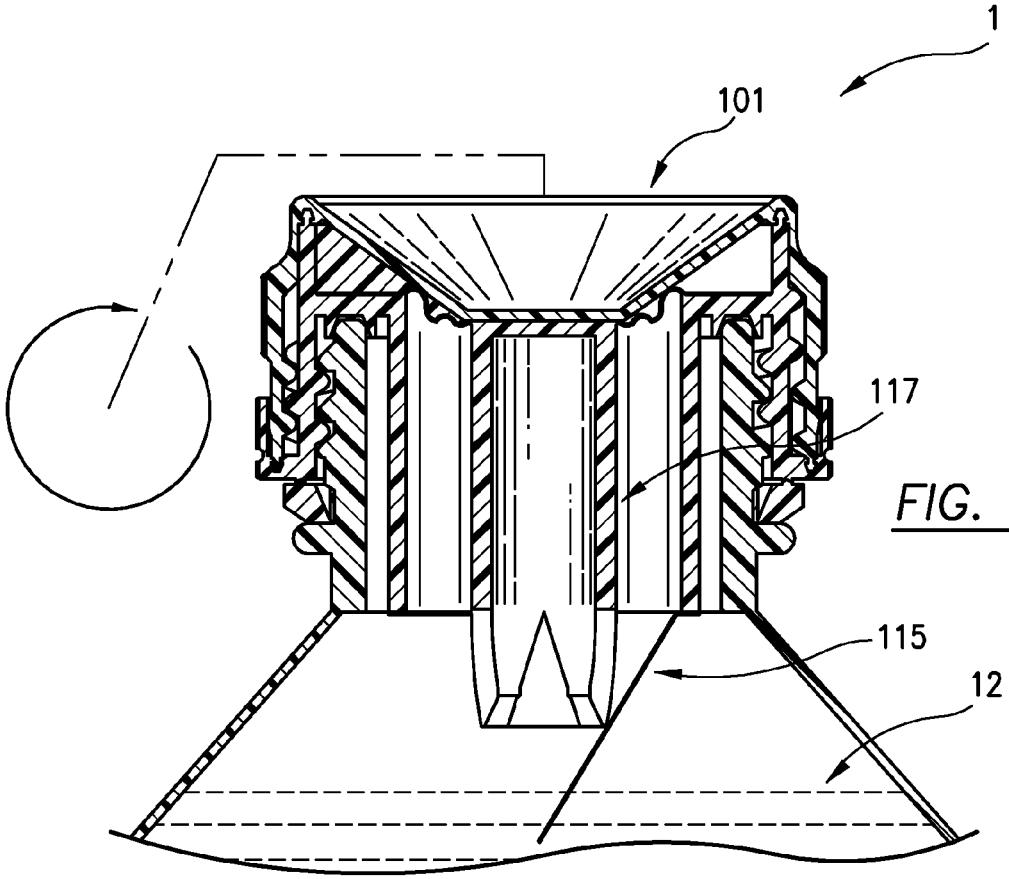
FIG. 10 is a sectional view of another embodiment of the dispensing capsule of the present invention in an engaged or deployed state.

In some embodiments, upper cap 10 and lower cap 11 are integrated into a single piece that is received on a pre-sealed container 12. This configuration is shown in FIGS. 7 and 8 and operates substantial the same as described above, wherein twisting the capsule 1 about concave depression 101 causes plunger 117 to translate downward and break the seal 115, releasing ingredient **116*a* from chamber 116 into the container 12. FIGS. 9 and 10 depict the one piece version of capsule 1 in more detail. As shown in FIG. 9, the capsule 1 contains internal threads 119 which are configured to engage the container threads 122 of container 12. Capsule 1 is sealed by lower sealing member 115 through which plunger 117 penetrates when the device is twisted. Again, a first ingredient is storage within the capsule 1 and is configured to be released and mixed with a second ingredient 123 in container 12. FIG. 10 is another depiction of the capsule 1** in its deployed position.

Figure 11:
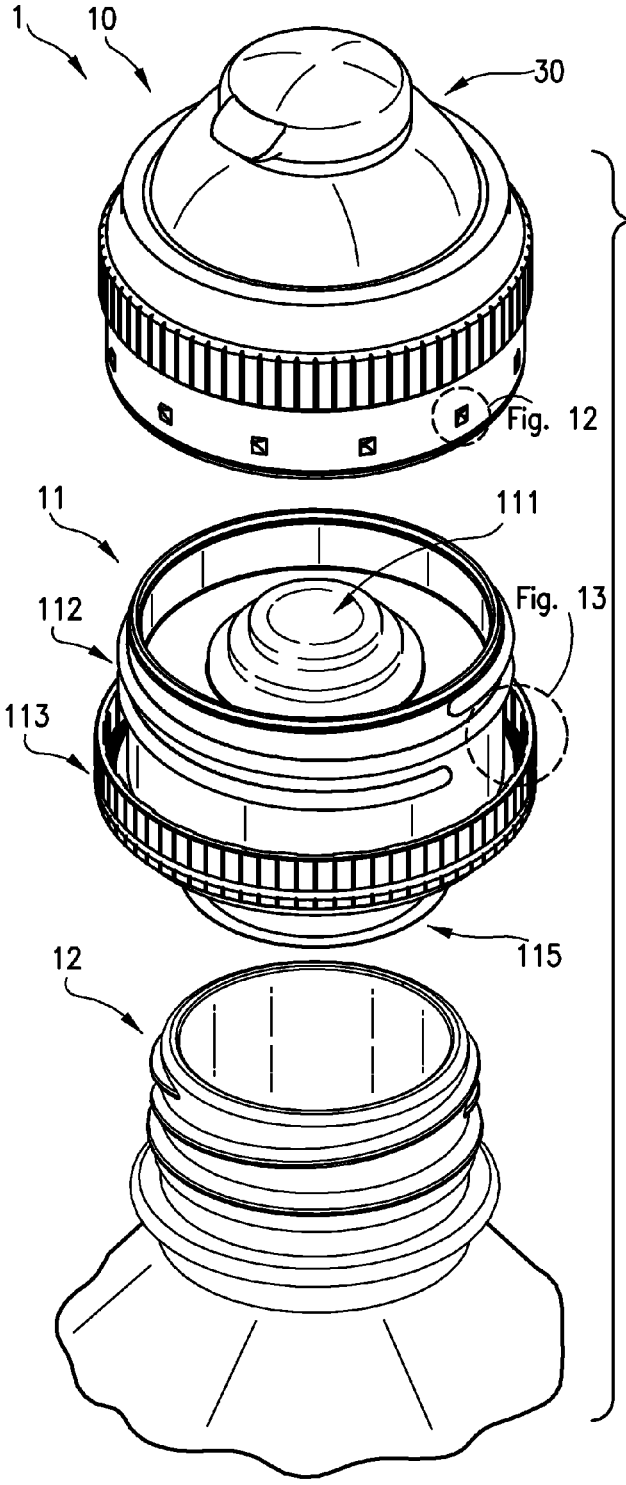
FIG. 11 is a breakaway view of another embodiment of the dispensing capsule of the present invention having a cover and lid feature.
Figure 12:
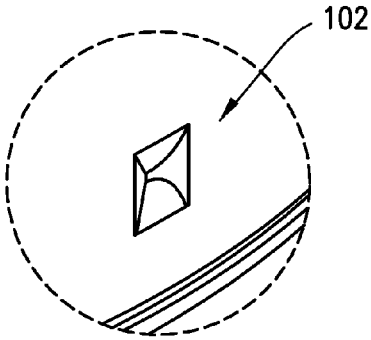
FIG. 12 is an exploded view of a locking feature of the dispensing capsule of the present invention shown in FIG. 11.
Figure 13:
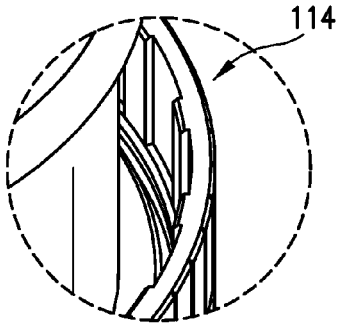
FIG. 13 is an exploded view of another locking feature of the dispensing capsule of the present invention shown in FIG. 11.
Figure 14:
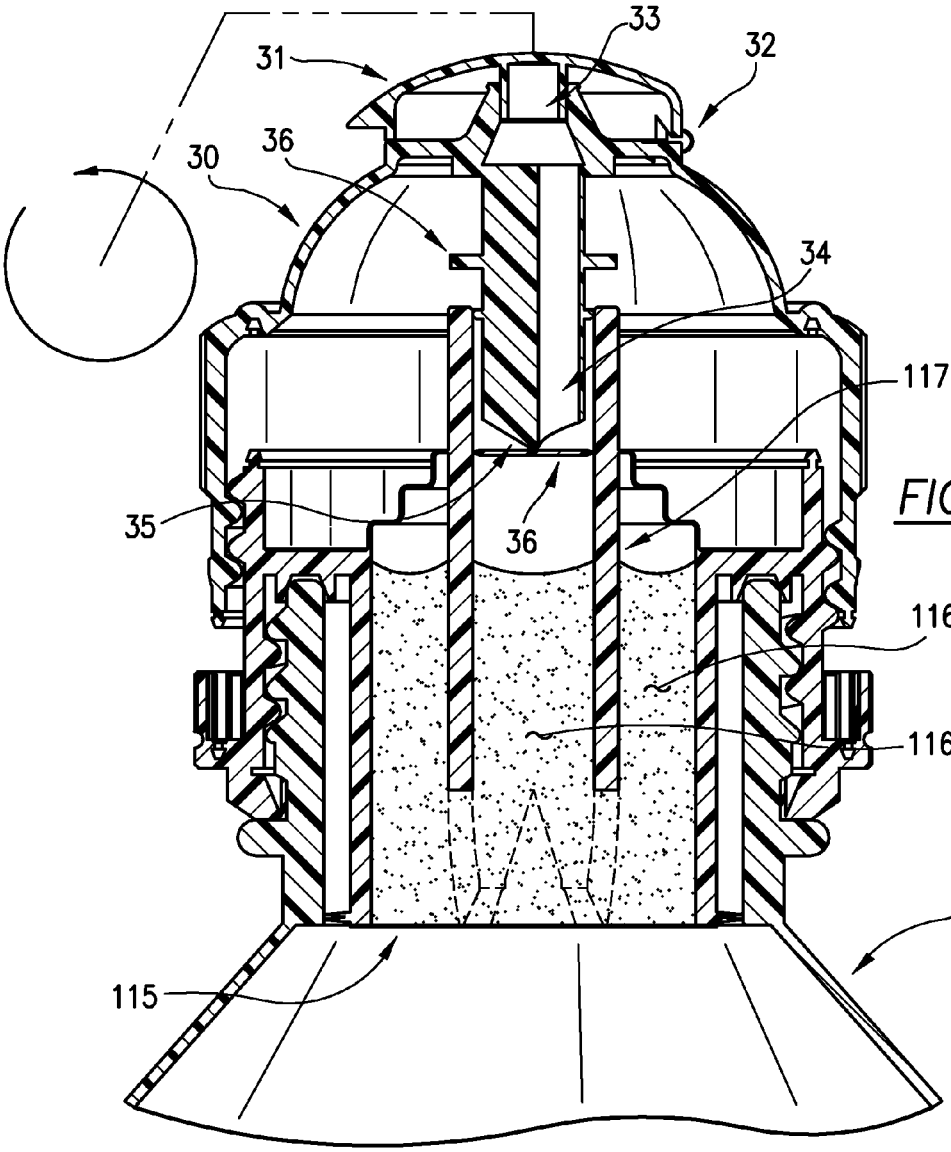
FIG. 14 is an section view of the dispensing capsule of the present invention shown in FIG. 11 in a pre-engaged state

With reference to FIGS. 11-13, shown is another embodiment of the capsule 1 of the present invention outfitted with a drink-through upper cap 10 wherein a cover 30 is disposed over the top of upper cap 10 covering the concave depression 101. The remaining features are substantially similar to the embodiment shown in at least FIGS. 1-4. The capsule 1 is such that the engagement of the protrusions 114 with the cut-outs 102 prevents re-opening of the capsule 1 and permits removal of the liquid mixture only though an opening in the upper cap 10, which is covered with cover 30. With references to FIG. 14, shown is a sectional view of the embodiment in FIGS. 11-13. Shown is cover 30 having a resealable lid 31, which may be hingeably connected to the cover 30 by hinge 32. To prevent leakage of the container 12, a depressible closure action is provided. Cover 30 includes a spout 33 which is in flow communication with an at least partially hollow plug 34. Plug 34 is pressure fit against pressure seal 35 in order to prevent moisture from entering the chamber 116 and damaging or destroying the first and/or second ingredients before dispensing is desired. Upon twisting upper cap 10, the cover 30 will twist also, causing downward force on both plug 34 and plunger 117 which causes pressure seal 35 and lower sealing member 115 to break in succession, dumping the contents of chamber 116 into the container 12 and allowing for eventual dispensing of the mixture back up through the lower cap, upper cap, and cover 30 and out of spout 33.

Figure 15:
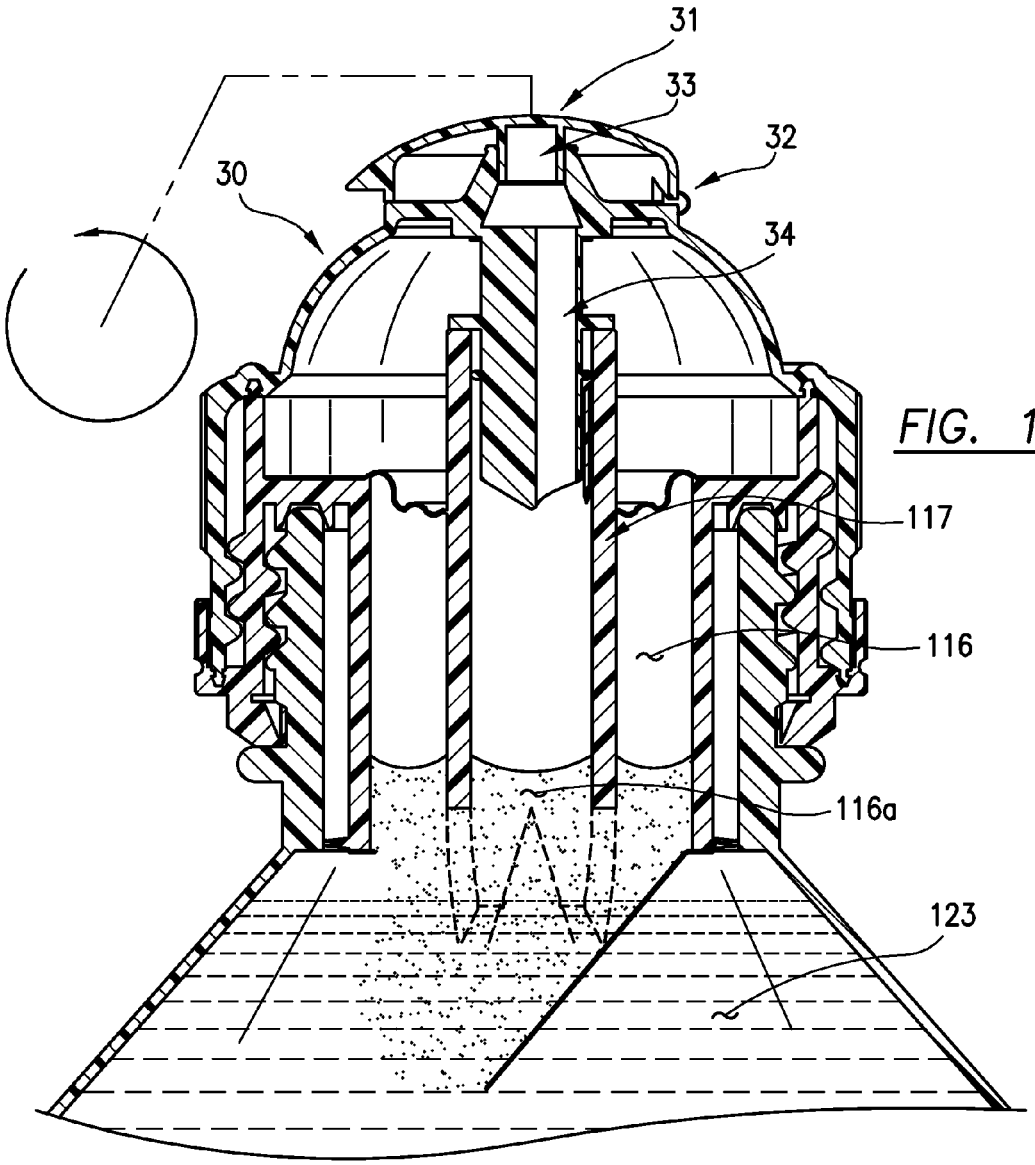
FIG. 15 is an section view of the dispensing capsule of the present invention shown in FIG. 11 in an engaged state
Figure 16:
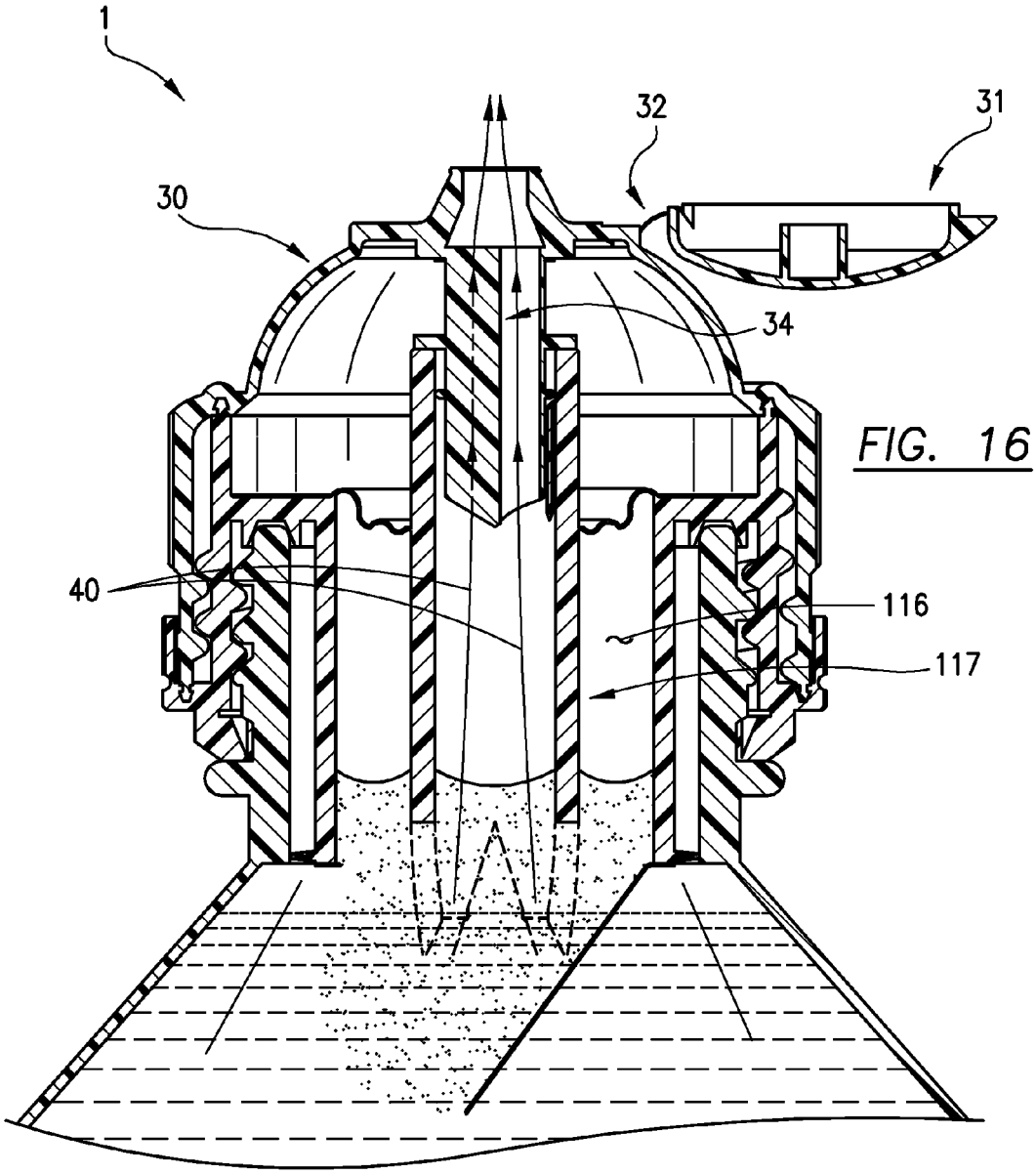
FIG. 16 is a section view of the dispensing capsule of the present invention shown in FIG. 11 in an engaged state, showing the flow of the mixture out of the spout of the capsule.

In some embodiments, a circumferential stop 36 is provided to prevent the plug 34 and thus cover 30 from displacing too far into the capsule 1. FIG. 15 depicts this embodiment with the pressure seal 35 and the lower sealing member 115 both broken, allowing for the first ingredient 116*a* to pass into container 12 and mix with second ingredient 123. As shown, plunger 117 is hollow such that it is coaxial with and in flow communication with the plug 34 and then spout 33 defining a flow pathway allowing the user to dispense the mixture out of the device. FIG. 16 demonstrates the flow of the mixture out of the spout 33. As shown, lid 31 is hinged open about hinge 32. Mixture 40 travels up through plunger 117 (within chamber 116), through plug 34 and out spout 33.

Figure 17:
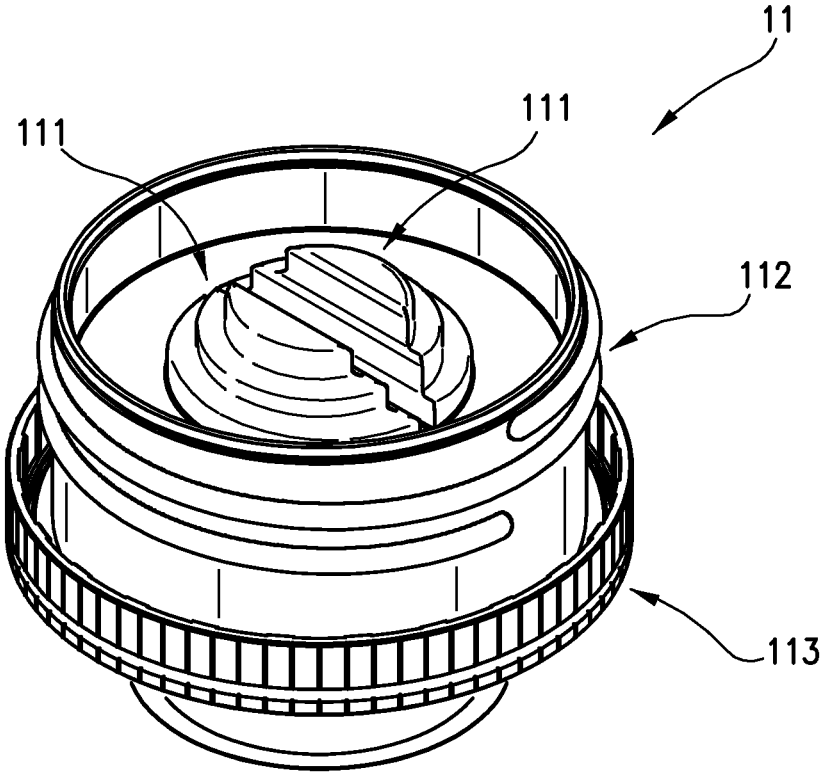
FIG. 17 is a perspective view of one embodiment of the lower cap of the present invention having a bi-furcated plunger seal.

FIG. 17 shows an alternative embodiment of the present invention wherein the plunger seal 111 is bi-furcated to allow for the use of two plungers 117 within the chamber 116.

It is appreciated that the present invention provides a dispensing capsule having a sealed ingredient chamber and a plunger that is activated by a twisting motion. The chamber can contain any liquid, powder and or gasses and or micro/nano encapsulation in any combination desired. The dispensing capsule can be mounted or applied at any location of a container including a bottle, pouch, can, IV bag, drum or tote. In some embodiments, the capsule is suited to be received on the threaded opening of such containers in order to provide a leak-free fitment. The chamber of the dispensing capsule stores any desired ingredient and may be dimensioned as desired to fit a variety of applications. The size and shape of the capsule of the present invention should not be construed as limited to the sizes and shapes shown in the drawings herein. Rather, the volume of the chamber and the diameter of the various components can vary as desired and/or can vary depending on the size and shape of the intended container 12 or other parameters. Further, the chamber need not be filled completely, but rather can accept any volume of an ingredient desired depending on mixing parameters and the desired final product.

By way of example only, the device can be used for drinks, hair care, pet products, drugs, over the counter medications, cleaning products, soups, dressings, nitrogen, fuels and engine cleansing, oils, waxes, pH enhancers, oral care, oxygen, adhesives and other categories of use depending on the ingredients and formulas. Also a coating of any type of moisture absorbent can be applied to the inside of the invention to act as a desiccant and allow for moisture absorption of any excess moisture that may be contained inside the invention when filled and sealed.

This dispensing capsule can be molded in one or two pieces thus eliminating a high cost to manufacture other dispensing caps that are multiple pieces and difficult to fill and seal the ingredients desired. Furthermore, due to the encapsulated capsule excluding the sealing area the invention allows the ingredients to remain moisture free and have an usually long shelf life and allowing with the sealed chamber to combine liquids and powders and oils and other ingredients to be sealed and stored separately if desired to prevent any reaction with one another. Also the device can include multiple applicators such as drinking spouts, pouring spouts and removable dosing cap for use of a product with one or more multiple chambers and plungers that have flow through to allow dispersing of all ingredients into a desired container. The invention can be made of any material or any combination of materials such as plastics, metals, resins, and the like thus allowing different container uses and applications.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dispensing capsule, comprising:

an upper cap having a concave depression;

a lower cap defining an internal chamber adapted to contain a first ingredient and having an upper flexible seal comprising a stepped bellow, a lower sealing member, and a plunger having a forked distal end disposed in said internal chamber, said plunger engaged with said upper flexible seal;

said upper cap threadingly engaged with said lower cap;

said lower cap adapted to threadingly engage a container;

wherein twisting said upper cap with respect to said lower cap causes said concave depression to apply downward force to said upper flexible seal, causing said plunger to displace downward such that said forked distal end breaks said lower sealing member, dispensing said first ingredient from said internal chamber and;

wherein a lower portion of said upper cap includes one or more circumferentially disposed cut-outs, said cut-outs configured to lockingly engage one or more protrusions on the inside of an outer race of said lower cap when said upper cap is entirely completely onto said lower cap.

2. The dispensing capsule of claim 1, wherein said internal chamber is adapted to contain a solid, a liquid, a gas, or combinations thereof.

3. The dispensing capsule of claim 1, wherein said first ingredient is adapted to mix with a second ingredient contained in said container.

4. The dispensing capsule of claim 1, further comprising a cover covering said upper cap.

* * * * *